United States Patent [19]

Beery

[11] 4,019,980

[45] Apr. 26, 1977

[54] MULTIPLE HYDROCYCLONE ARRANGEMENT

[75] Inventor: James P. Beery, Springfield, Ohio

[73] Assignee: The Bauer Bros. Co., Springfield, Ohio

[22] Filed: Jan. 24, 1975

[21] Appl. No.: 543,868

[52] U.S. Cl. ..... 209/211; 210/512 M

[51] Int. Cl.[2] ..... B04C 5/28

[58] Field of Search ..... 209/211, 144; 210/512 M; 55/349, 346

[56] References Cited

UNITED STATES PATENTS

| | | | |
|---|---|---|---|
| 2,622,735 | 12/1952 | Criner | 209/211 |
| 2,910,178 | 10/1959 | Bonneau | 209/144 |
| 3,335,860 | 8/1967 | Baxter | 209/211 |
| 3,543,931 | 12/1970 | Rastatter | 209/211 |
| 3,598,731 | 8/1971 | Frykhult et al. | 210/512 M X |
| 3,717,255 | 2/1973 | Rowland | 210/512 M |

FOREIGN PATENTS OR APPLICATIONS

| | | | |
|---|---|---|---|
| 835,884 | 5/1960 | United Kingdom | 210/512 M |

*Primary Examiner*—Frank W. Lutter
*Assistant Examiner*—Ralph J. Hill
*Attorney, Agent, or Firm*—Jerome P. Bloom

[57] ABSTRACT

A cleaner system providing a compact package capable of installation and use in a minimal of space and substantially without loss of space by reason of its configuration. The arrangement provides for free access to all components. In preferred embodiment the system features vertically oriented pipe-like conduits serving as accepts and rejects headers which per se support vertically spaced pairs of cleaners connecting directly to said conduits in straight line configurations and with their rejects ends lower than their accepts ends. The cleaners of each pair are arranged parallel and functionally coupled to provide that to one end their accepts move in essentially parallel straight line flow to and tangentially inward of respectively opposite sides of the interior wall surface of the related accepts conduit. Their rejects flow in like fashion to and tangentially inward of respectively opposite sides of the interior wall surface of the related rejects conduit. The nature of the entry of accepts and the rejects into the respective conduits provide for an interfering flow pattern which renders more efficient and effective the suction means which are applied to one end or the other of the conduits, in accordance with the desired end results.

21 Claims, 7 Drawing Figures

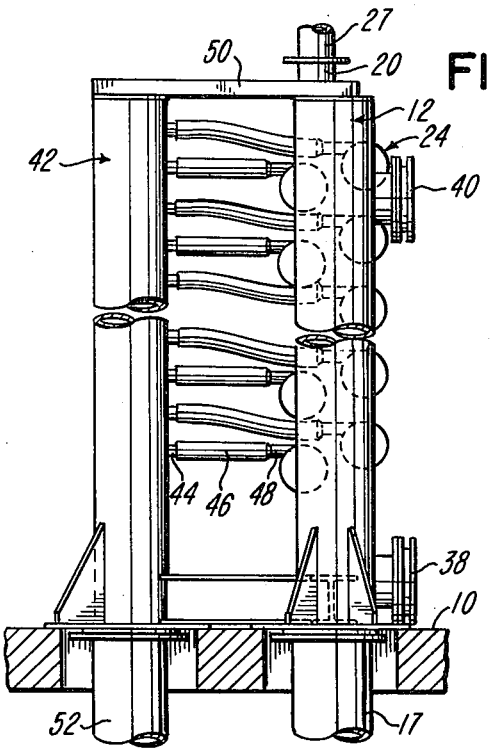
FIG-3
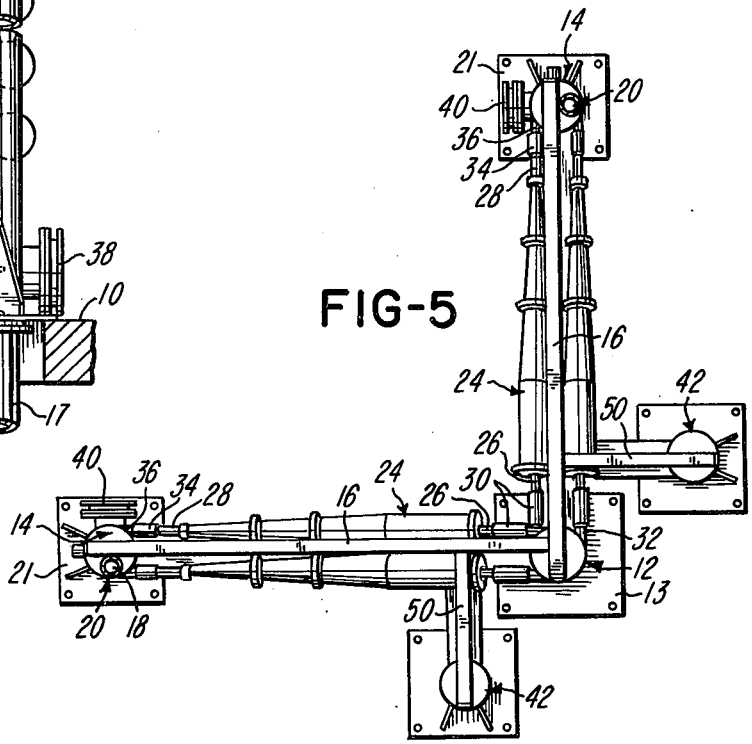
FIG-5
FIG-4
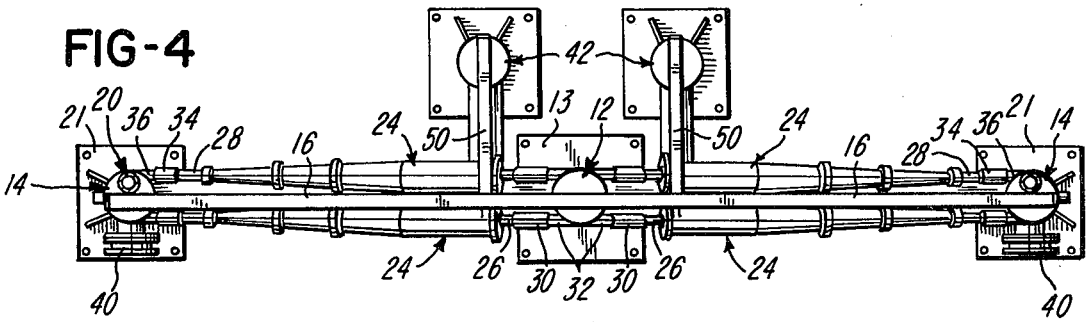

FIG-7
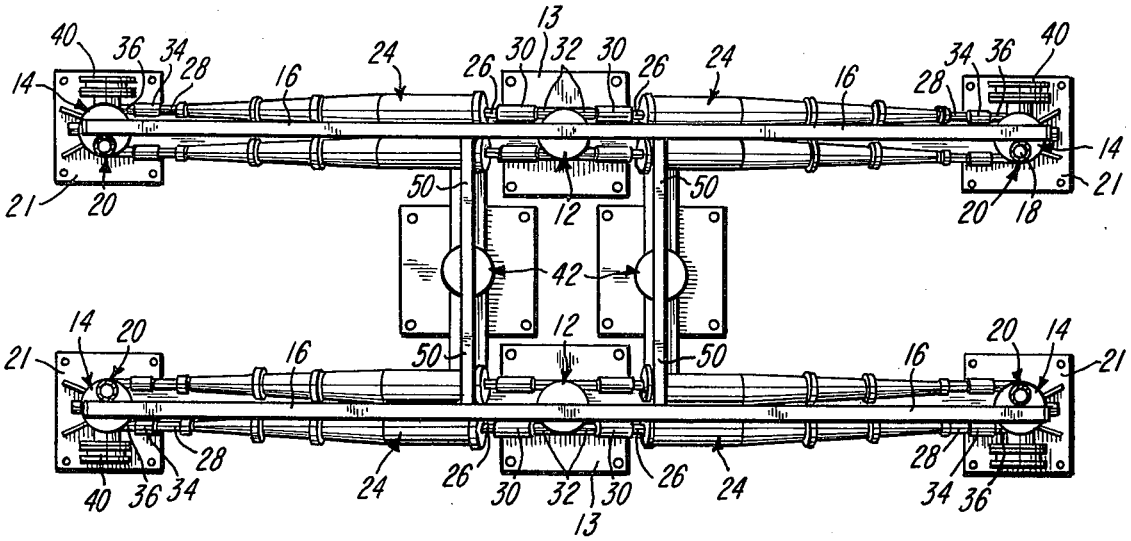
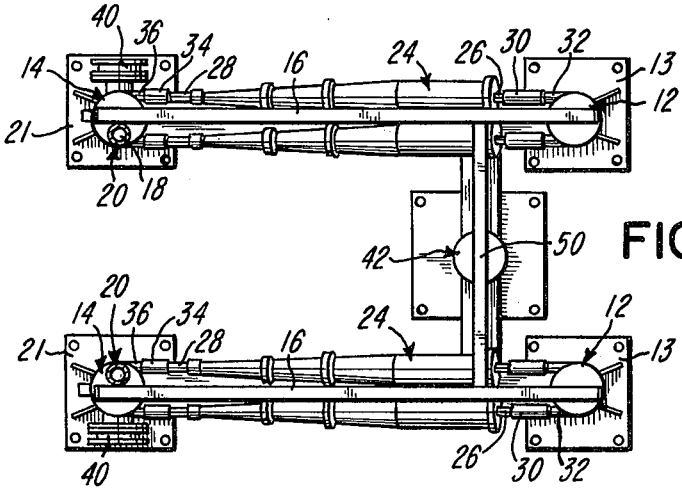
FIG-6

MULTIPLE HYDROCYCLONE ARRANGEMENT

THE INVENTION

This invention relates to improvements in cleaner installations and more particularly to a simple and economical cleaner package, multiples of which can be easily and quickly installed with a minimum of hardware and so as to produce optimal results.

BACKGROUND OF THE INVENTION

The separation of accepts from rejects and the extraction of air from entrained materials in reducing, processing, and/or conditioning raw or reclaimed materials has presented continuing problems, particularly evidenced in the separation and the conditioning of fibers in the pulp and paper industry. An important tool for use in such procedures is the centrifugal cleaner, which for any degree of efficiency in their use must be applied, in a single installation, in great numbers. A normal installation of such cleaners entails, therefore, a substantial amount of plumbing and hardware and the availability of a considerable amount of space. This in itself creates problems to the solution of which much money, time and effort has been applied. Other problems incident to such an installation are the power and pressure loss factors normally entailed in its operation, a direct result of which is a basic lack of operating efficiency as evidenced in prior art installations. Not the least of the problems in prior art installations of centrifugal cleaners is that they do not lend themselves to easy installation, maintenance or observation of the cleaner operation. It is to the solution of such problems the present invention has been directed, with unexpected and highly advantageous results.

The present invention provides a new and improved centrifugal cleaner installation in a compact package form. The improvements embodied in this package and the elements thereof provide for a reduction, by about one half, of the floor space normally required for a comparable installation. Incident to the use of the package concept of the present invention is a substantial savings in hardware and plumbing and the elimination of any mystique in the installation procedure, saving thereby a considerable amount of time and cost in the making of a cleaner installation. The package is that efficient in operation, moreover, that the use thereof reduces the horespower requirements for cleaner operation. Not the least result of the invention package is the ability to use it to install the same in single and multiple numbers in any configuration and within the limitations of available floor space. It also creates an environment for the packaged cleaners lending ease of access and observation of the cleaners and the related package components.

A preferred cleaner package in accordance with the invention comprises a first pipe-like conduit and a second pipe-like conduit which respectively serve as a vertical rejects header and a vertical accepts header. One end of each of these conduits is designed to seat to and open from a common base floor surface. Intermediate their respective ends the pipe-like conduits are bridged by centrifugal cleaners arranged in pairs which are vertically spaced.

The cleaners of each pair are so arranged as to position in closely spaced generally parallel relation and each has means defining an axially directed accepts outlet coupled to means defining an inlet directed tangential to the interior wall of one of the conduits. Each also has means defining an axially directed rejects outlet axially extended by and coupled to means defining an inlet directed tangential to the interior wall of the other of the conduits. By the structure provided, the accepts from the respective cleaners of each pair will thus enter the accepts conduit to which they are coupled at opposite sides of its interior wall surface and initially move therein in a swirling flow pattern. The rejects will enter the rejects conduit in like fashion.

It is a feature of the preferred embodiment illustrated that the line of flow through and from the cleaners to the related conduits is not only straight but inclined to a horizontal, the rejects end being lower than the accepts end.

The invention further contemplates means connected to apply vacuum to one end of one or more of the conduits whereby to extract undesired components of the flow, primarily air.

The line concept of a mount and connection of the elements of one package or as combined in a plural package form insures maximum flexibility in application and use.

A primary object of the invention is to provide an improved cleaner installation which is more economical to fabricate and install, easier to use and maintain, more efficient and more satisfactory in operation and unlikely to malfunction.

Another object is to provide a uniquely compact cleaner package which may be easily erected on site and coupled to additional packages in a simple and economical manner.

A further object is to provide a new concept in cleaner installations providing improvements in components and their function and possessing the advantageous features, the inherent meritorious characteristics and means and mode of use herein described.

With the above and other incidental objects in view as will more fully appear in the specification, the invention intended to be protected by Letters Patent consists of the features of construction, the parts and combinations thereof, and the mode of operation as hereinafter described or illustrated in the accompanying drawings, or their equivalents.

Referring to the drawings wherein some but not necessarily the only forms of embodiment of the invention are shown, FIG. 1 is a top plan view of the basic elements of a cleaner package as installed per the present invention, parts being shown in schematic form;

FIG. 3 is an end elevation view thereof; and

FIGS. 4–7 show modification of the package of FIG. 1 illustrating multiple usage per the present invention.

Like parts are indicated by similar characters of reference throughout the several views.

Figure 1:
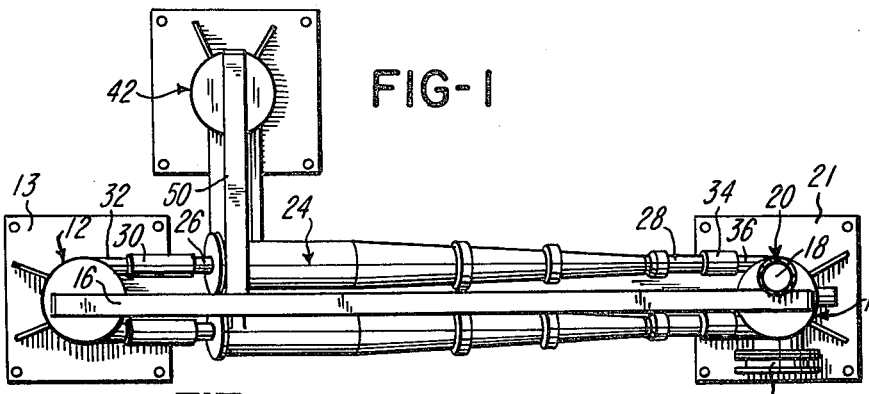
Figure 2:
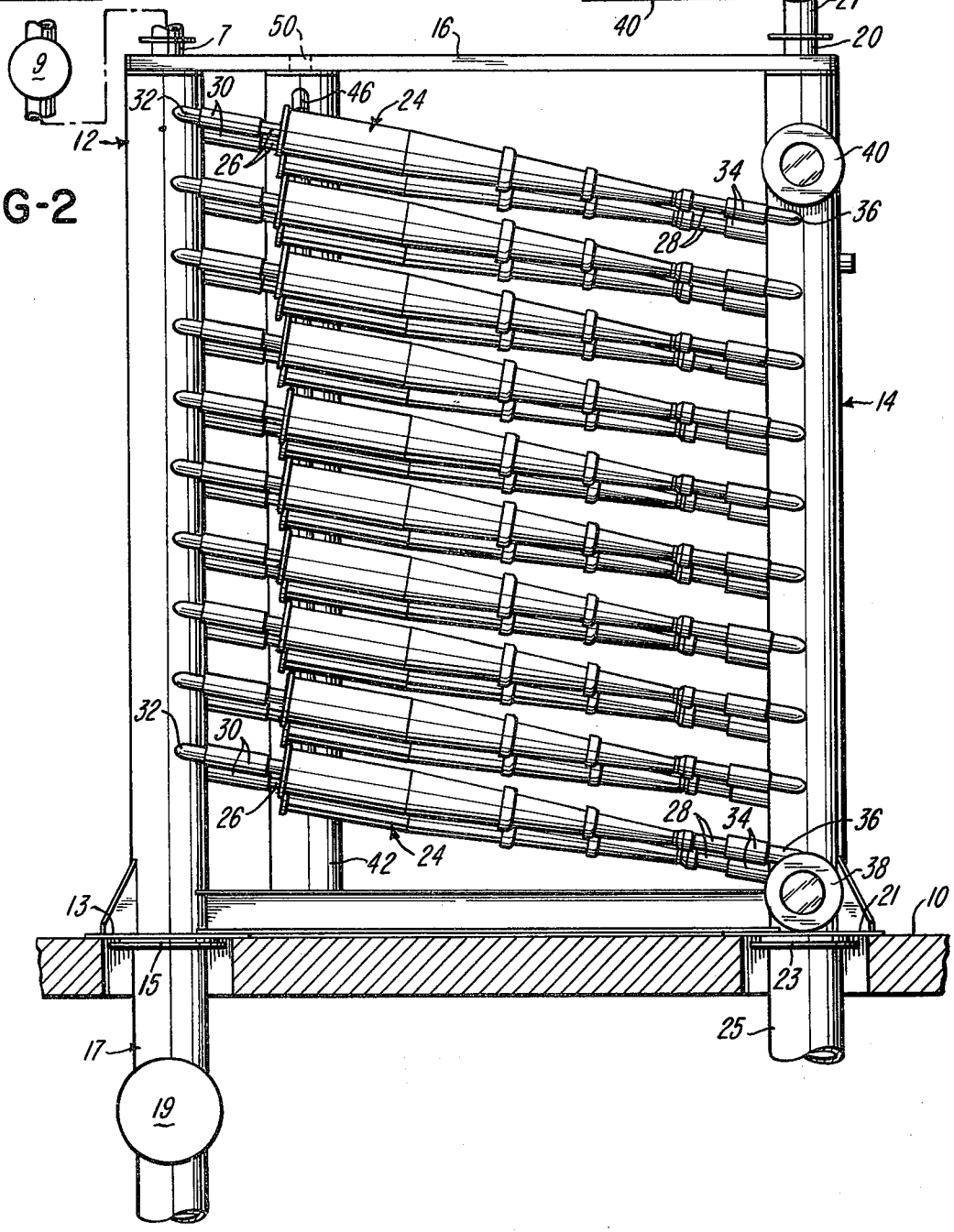
FIG. 2 is a side elevation view thereof.

Referring to FIGS. 1–3 the basic elements of the invention in a preferred installation thereof provide a package mounted on and extended upward from a floor surface 10 which provides its base. Mounted to seat on and project vertically from the floor 10 is a first pipe-like conduit 12 and a second pipe-like conduit 14. As may be seen in FIG. 2, the lower end of each of the conduits 12 and 14 opens through the floor 10.

In the case of the conduit 12, which constitutes an accepts header and defines an accepts flow path, its base flange 13 is coupled to an external flange 15 on an axially aligned pipe-like conduit 17. The latter is accommodated in an opening in the floor 10 and extends therefrom for suitable connection to a recovery chest and/or further processing equipment. As shown, a pump 19 is suitably incorporated to influence the flow, and there may be added a thickener and/or other processing equipment as might suit the particular application. It is contemplated in the preferred embodiment shown that a vacuum pump 9 will be connected into a conduit 7 communicating with the top of the conduit 12. The pump 9 will function to evacuate air entrained in the accepts flow which moves to and through the conduit 12 and from this conduit by way of the conduit 17.

In the case of the conduit 14, which in the example shown constitutes a rejects header, its base flange 21, which peripherally seats to the floor 10, is coupled to a flange 23 on one end of a pipe-like conduit 25. This coupling is accommodated, as shown in FIG. 2, by an opening in the floor 10. The conduit 25, as thus provided, defines a path for a free flow discharge of the rejects which are received in and carried from the cleaner installation by way of the conduit 14, for recovery or further processing.

The upper ends of conduits 12 and 14 are shown in FIG. 1 to be bridged by a suitably interconnected bar 16. The top of each of conduits 12 and 4 is closed except that each has an opening to one side of the bar 16. The opening 8 in the top closure for the conduit 12 is rimmed by the vertically projected conduit 7 while the opening 18 in the top closure for the conduit 14 is rimmed by a vertically projected adapter tube 20. The latter is coupled to a condit 27, in which is interposed a suction pump 22 the purpose of which will be further described.

Bridging the pipe-like conduits 12 and 14 at vertically spaced intervals, between the bar 16 and the floor 10, are a series of paired centrifugal cleaners 24. Each cleaner 24 has a pipe-like axial extension 26 defining an accepts outlet to one end which is cylindrically formed and a pipe-like extension 28 defining an axially projected redjects outlet at its opposite conically reduced end. In each case the pipe-like axial extension 26 is in line with and coupled by a resilient sleeve 30 to an axially aligned pipe-like projection 32 in connection with and forming a tangential inlet to the conduit 12. Similarly, the pipe-like extension 28 is coupled by a resilient sleeve 34 to an axially aligned pipe-like projection 36 connected with and forming a tangential inlet to the conduit 14.

Thus, as shown in FIG. 2, the longitudinal axis of each cleaner 24 is in direct axial alignment with the means 32 and 36 forming the tangential inlets to the respective conduits 12 and 14 and coupled to maintain such alignment as described.

Considering the relation of the cleaners 24 in each of the vertically spaced pairs, it will be seen from FIG. 1 and FIG. 2 that their longitudinal axes are parallel. Moreover to one end thereof their parallel axial extensions 26 are connected to direct the accepts channelled thereby through their couplings and the related tangential inlet devices 32 to enter the conduit 12 on opposite sides of its interior wall. As seen in FIG. 2, the longitudinal axis of one cleaner 24 in each pair is slightly offset from the other, in a vertical sense. Each accepts flow will be enabled thereby to commence a free moving vortex flow pattern on its entry to the vertical flow chamber defined by the conduit 12. This free moving vortex flow pattern from adjacent accepts outlets of paired cleaners is, however, quickly interrupted since the paired flows are moving counter to each other. The net result is a degree of shear and impact of the particles contained in the opposite flowing accepts, producing a degree of further separation of the elements of the solids components of the accepts. An important effect of this action is the release of air which may have been trapped in the solids accepts which issued from the cleaners 24. One result is that the accepts moving through and from the conduit 12 will be well defined and effectively separated from unwanted entrapped air. The conditions are such to facilitate withdrawal of air under the influence of an operation of the vacuum pump 9 and recovery of the accepts in an optimal condition for use. Please note that the pump 19 is incorporated in the accompanying drawings in a generally diagrammatic fashion. It should be understood that this pump may be connected and located, with respect to the accepts discharge, to facilitate its flow, in a variety of positions the choice of which will be dependent upon the application.

It will be observed that even with the interference prescribed, the nature and character of the installation is such that there will be a minimal incidence of back pressure and the degree thereof will not interfere with a smooth and rapid extraction of the accepts resulting from an operation of the cleaner installation.

To the other end of the paired cleaners, in the instance of each pair thereof their axial extensions 28 are also parallel and connected to direct the rejects channelled thereby through the couplings 34 to the aligned tangential inlet devices 36. As in the case of the accepts, the rejects of the respective cleaners in a pair will similarly enter opposite sides of the condit 14 to which they are coupled, initially in free moving vortex flow patterns.

In accordance with the invention the reject ends of the cleaners 24 are lower than their accept ends, the longitudinal axes of the cleaners being displaced from a horizontal from 5° to 30° and preferably 15°. Also, the reject flows from paired cleaners are on levels one of which is slightly above the other. This last is due to the slight vertical offset of the longitudinal axes of the cleaners previously noted. The structure as thus provided determines that the rejects will have a full and positive flow pattern and the rejects from paired cleaners will be initially free though counterflowing into the conduit 14, one relative to the other. Shortly after entry, however, the counterflowing rejects of paired cleaners will be influenced by impact and shear effects produced as previously described to reduce and separate to some extent and to release trapped air in the process. Where the system has a vacuum reject operation, the net result of this interference as produced by the invention is a most effective withdrawal of air by suction applied to the upper end of the conduit 14 through the medium of an operation of the pump 22. Even with submerged operation, in respect to the rejects, entrapped air will be released as a consequence of the arrangement for rejects discharge to the conduit 14 and such air will move up through the liquids in the conduit 14 and thereby separate from the solid rejects to a location where the operation of the pump 22 can effectively extract the air.

It will be understood, of course, that the respective sight glasses 38 and 40 embodied in the conduit 14, one adjacent its bottom and the other adjacent to but spaced from its top, will facilitate quick and easy observation of the rejects operation whether there is a vacuum rejects operation or submerged operation. A pipe-like conduit 42 mounted adjacent to the conduit 12 projects vertically of the floor 10, directly to one side of the wall formed by the conduits 12 and 14 and the bridging cleaners 24. The conduit 42 is used to deliver to the cleaners 24 a mixture of materials, in a slurry or like form, the constituents of which are to be cleaned and/or separated in the course of a centrifugal separating action produced by the passage thereof to and through the cleaners. As seen in FIG. 3, the conduit 42 is supplied with such materials through an axially aligned pipe 52 coupled to the lower end thereof through an opening in the floor 10. Incorporated in the wall of the conduit 42, at vertically spaced points above the floor 10, are small bore delivery tubes 44 coupled in each case by a flexible sleeve 46 to a pipe-like means 48 defining a tangential inlet to the body forming the separating chamber of a cleaner 24. Bar 50 bridges and connects to the upper closed end of conduit 42 and bar 16 to integrate the package formed by the vertical conduits and the cleaners supported thereby.

Please not that the centrifugal separating action produced in the cleaners 24 is not here described since the same is well known to those versed in the art. Otherwise, it is believed that the foregoing description makes the nature and character of the system of the invention, and its operation, quite clear.

The simplicity of the structural concept of the cleaner package of the invention as well as its erection is believed self-evident from the foregoing description of a preferred embodiment. It will be seen therefrom that the elements of the package are few and require no complicated hardware or extensive plumbing in their connection. The orientation of the cleaners and the direct straight line flow of the accepts and rejects to the cleaner supports which per se form vertical accepts and rejects headers, as shown, avoids creation of undue back pressures in the cleaner operation. A smooth and rapid movement of the materials results in all respects. There are no devious paths through which the materials must move and the travel of the materials from one point to another is of a minimal nature. The package further features an orientation of the cleaners which insures that on shut-down of the system there is quick evacuation of the cleaners.

What has been heretofore particularly unobvious is the concept of the present invention by reason of which there is afforded a capability of providing a simple pre-arranged and basic cleaner package having a minimal number of parts which can be arranged in a direct line and provided in a manner to facilitate erection, removal and interchange of parts, as and when required. This erector set capability affords not only a simple and compact arrangement but one which can be quickly installed and readily expanded without special talent or cost.

The facility with which the basic package may be expanded is seen, by way of example, in FIGS. 4–7 of the drawings. FIG. 4 shows an in-line expansion which can double the cleaner capacity of the showing in FIGS. 1–3. This installation will require two basic packages such as seen in FIGS. 1–3 less one pipe-like conduit or accepts header 12. In the installation of FIG. 4, the single accepts conduit 12 is centered to position perpendicularly of the floor 10 and between and in-line with two rejects headers in the form of pipe-like conduits 14. Cleaners 24 are mounted between and supported by the conduits 12 and 14 in the same manner as described with reference to the showing in FIGS. 1–3. The only modification required of conduit 12 is that it be provided with oppositely directed pairs of tubes forming tangential inlets 32 respectively and slightly offset in a vertical sense. Since the component elements and connections of the installation are otherwise the same, the details thereof need not be here described. Thus, the difference in the FIG. 4 installation is that there are two vertical stacks of cleaners, one to either side of the central accepts conduit 12. While the latter, as will be obvious, serves to commonly have coupled thereto the accepts outlets from each of the stacks of cleaners, their offsets are nevertheless such that the accepts entering will still provide for the inflows of the paired accepts to function in the manner previously described with reference to the embodiment of FIGS. 1–3 of the drawings. Of course, the rejects conduits 14 have the rejects outlets of the cleaners coupled thereto and functionally related in the same manner as previously described with reference to FIGS. 1 and 3.

Thus the system of FIG. 1 can by a simple modification of a single centrally positioned accepts conduit be easily and economically extended in a straight line. The installation is of course facilitated by the erector set capability and concept of the invention system.

FIG. 5 is a modification of the installation shown in FIG. 4. As should be obvious, the only difference is that here the second vertical stack of cleaners 24 is positioned in a line at right angles to the first. In such a package, the only difference in construction is that the common accepts conduit 12 will have its respective tangential inlets related to the respective stacks of cleaners similarly positioned at right angles so as to maintain the line character of the travel of rejects and accepts to the interior of the related conduits or headers. FIGS. 6 and 7 respectively show how the capacity of the system effected per the showing in FIGS. 1–3 or FIG. 4 can be doubled. The connections and the structure required are believed quite clear. In the one instance the parallel lines of cleaners are doubled as to their extent. An additional difference in the showings in FIGS. 6 and 7 is the arrangements for supply conduits 42 to serve to commonly supply each of a pair of parallel sets of vertically stacked cleaners.

As noted, no further detailed description appears necessary with reference to the showings in FIGS. 4–7 in view of the fact that they do not involve structural modification which is not clear from the foregoing description and the drawings.

Thus, in summary, the invention creates a new concept in the composition and erection of cleaner systems, facilitating the use thereof in any line form arrangement and in a manner, as may be seen with reference to the accompanying drawings, that there is total and free access to each component of the installation. the net result, obviously, is that any component of the system may be readily reached and examined in quick and easy fashion.

The total of the system and the structural arrangement provided thus affords economy of space, economy of labor, economy of capital costs and facility in use. The fact that there is a minimal travel path in the system operation and straight line flows insures a minimal of friction losses, minimal back pressures, if any, and a low energy consumption in use.

From the above description it will be apparent that there is thus provided a device of the character described possessing the particular features of advantage before enumerated as desirable, but which obviously is susceptible of modification in its form, proportions, detail construction and arrangement of parts without departing from the principle involved or sacrificing any of its advantages.

While in order to comply with the statute the invention has been described in language more or less specific as to structural features, it is to be understood that the invention is not limited to the specific features shown, but that the means and construction herein disclosed comprise but one of several modes of putting the invention into effect and the invention is therefore claimed in any of its forms or modifications within the legitimate and valid scope of the appended claims.

The embodiments of the invention in which an exclusive property or privilege is claimed as defined as follows:

1. A cleaner system comprising a first pipe-like conduit, a second pipe-like conduit, at least one centrifugal cleaner including means defining an axially directed accepts outlet and means defining an axially directed rejects outlet, said means defining an axially directed accepts outlet being axially extended by means defining a tangential inlet to said first pipe-like conduit and said means defining an axially directed rejects outlet being axially extended by means defining a tangential inlet to said second pipe-like conduit, whereby to provide that the accepts and rejects enter the respective conduits in vortex flow pattens conducive, inherently, to the separation of constituents embodied therein, a second centrifugal cleaner positioned adjacent and in vertically offset generally parallel relation to said one cleaner having means defining an axially directed accepts outlet axially extended by means defining a tangential inlet to said first pipe-like conduit arranged to direct accepts to move into said first pipe-like concuit in a flow counter to that of the accepts directed interiorly of said first pipe-like conduit from said first-mentioned centrifugal cleaner and said second centrifugal cleaner further having means defining an axially directed rejects outlet axially extended by means defining a tangential inlet to said second pipe-like conduit.

2. A cleaner system comprising a first pipe-like conduit one end of which provides a base to seat the same to a floor surface, a second pipe-like conduit one end of which provides a base to seat the same to a floor surface in a spaced generally parallel relation to said first pipe-like conduit, centrifugal cleaners positioned between said conduits and arranged in a vertically offset relation, said cleaners including means defining an axially directed accepts outlet having in connection therewith means forming an axial extension thereof providing an inlet to said first pipe-like conduit, said cleaners having means defining an axially directed rejects outlet having in connection therewith means forming an axial extension thereof providing an inlet to said second pipe-like conduit, the respective extensions of a vertically offset pair of said cleaners being arranged to respectively direct their accepts and rejects into the respective conduits in counterflowing vortex flow patterns producing impact and shear effects producing a release from said accepts and rejects of trapped air to facilitate its extraction.

3. A cleaner system comprising a first pipe-like conduit, a second pipe-like conduit, and a pair of centrifugal cleaners including means defining an axially directed accepts outlet and means defining an axially directed rejects outlet, said means defining an axially directed accepts outlet being axially extended by means defining a tangential inlet to said first pipe-like conduit and said means defining an axially directed rejects outlet being axially extended by means defining a tangential inlet to said second pipe-like conduit, said pipe-like conduits serving as supports for said pair of said cleaners, adjacent outlets of which are coupled by their axial extensions to a single one of said pipe-like conduits to provide for tangential inflow therefrom opposite sides of the interior wall of the respective one of the conduits to which they are coupled.

4. A cleaner system as in claim 3 wherein said first and second pipe-like conduits are arranged in spaced parallel relation and said pair of cleaners supported thereby are disposed to have their longitudinal axes inclined with respect to the longitudinal axes of said conduits.

5. A cleaner system as in claim 4 wherein said conduits are vertically orienting supports and the angle of inclination of the longitudinal axes of said cleaners to the longitudinal axes of said conduits is in the neighborhood of 85° to 60°.

6. A cleaner system as in claim 3 wherein a third pipe-like conduit provides a supply line, for a slurry the constituents of which are to be cleaned and/or separated, positioned in adjacent relation to said first and second pipe-like conduits and to one side of said cleaners, and said cleaners are commonly connected to said third pipe-like conduit by means defining tangential inlets, for inflow thereto of the materials to be cleaned and/or separated.

7. A cleaner system as in claim 6 wherein means are connected to at least one of said first and second conduits to apply thereto a vacuum to draw air from the materials received therein and delivered thereby as a discharge from the coupled cleaners.

8. A cleaner system as in claim 3 wherein said conduits constitute vertical supports the lower ends of which provide delivery ends which seat to and open from a base surface and said conduits provide supports for a plurality of said pairs of cleaners which are similarly coupled to said conduits and arranged in a vertically spaced relation with their longitudinal axes and those of their axially directed outlets being oriented so the reject ends thereof and the means defining the tangential inlets to which they couple are lower than their accept ends.

9. A cleaner system as in claim 8 wherein a third pipe-like conduit constituting a third vertical support provides a line for delivering materials to be cleaned and/or separated by said cleaners and said cleaners have inlets for said materials which are commonly coupled to said delivery line.

10. A cleaner system as in claim 9 wherein means bridging and linking the upper ends of said conduits form thereby an integrated cleaner package, which may be installed in multiple relation so as to leave all elements fully exposed to provide free access for observation and/or maintenance procedures.

11. A cleaner system as in claim 9 wherein said second pipe-like conduit is a rejects header to the upper end of which is coupled a vacuum means for drawing air from the materials received in and discharged from said cleaners by way of said header.

12. A cleaner system as in claim 9 wherein means are connected to at least one of said conduits for drawing therefrom air contained in the material received and conducted thereby from said cleaners, the inflow to said conduits being characterized by counterflowing vortex flow pattern facilitating the drawing therefrom of said air.

13. A cleaner system as in claim 9 wherein said system has a generally T-shaped configuration in plan view providing a package a plurality of which may be installed in a compact nested relation to accommodate any floor configuration.

14. A cleaner system as in claim 3 wherein said first and second conduits are mounted to project vertically from a base surface and a third pipe-like conduit mounts similarly and in spaced parallel relation to said first and second conduits and at least one further pair of said parallel arranged cleaners is supported by and coupled to said third and one of said first and second conduits by axial extensions including tangential inlets to the conduits to which they are coupled so one of said conduits serves commonly as an accepts or rejects conduit.

15. A cleaner system as in claim 14 wherein said first, second and third conduits are arranged in a substantially straight line.

16. A cleaner system as in claim 15 wherein means for supplying a mixture of materials the constituents of which are to be cleaned and/or separated by said cleaners is provided by additional vertically oriented conduit means positioned adjacent and to one side of said line and the cleaners supported thereby and commonly connected to tangential inlets of said cleaners.

17. A cleaner system as in claim 14 wherein said third conduit is oriented at substantially right angles to the line on said first and second conduits.

18. a cleaner system as in claim 14 wherein said conduits mount a plurality of pairs of said cleaners in vertically spaced relation and with their longitudinal axes inclined to provide that their rejects ends are lower than their accepts ends.

19. A cleaner system as in claim 14 wherein there are a plurality of additional conduits arranged in a rectangular relation with respect to said first and second conduits and similarly mounting pairs of said cleaners, a portion of said additional conduits serving commonly as an accepts or rejects conduits, and said conduits mount said pairs of said cleaners in parallel lines providing clear passage for ready observation or maintenance of all components, and further conduit means are connected to said cleaners to supply thereto the materials to be cleaned and/or separated.

20. A cleaner system as in claim 19 wherein said cleaners and the couplings thereof to said conduits provide for essentially straight line discharge of accepts and rejects from said cleaners to the conduits to which they are coupled and by which they are supported to produce in said conduits supplementary vortex flow patterns of the materials received thereby minimizing the space and plumbing required for the installation of said system and producing an optimal and speedy cleaning and separating facility.

21. A cleaner system as in claim 20 wherein means are coupled to apply suction to draw air from the accepts receiving conduit or conduits to provide thereby for delivery of said accepts in the best possible form.

* * * * *

UNITED STATES PATENT AND TRADEMARK OFFICE

CERTIFICATE OF CORRECTION

PATENT NO. : 4,019,980

DATED : April 26, 1977

INVENTOR(S) : James P. Beery

It is certified that error appears in the above-identified patent and that said Letters Patent are hereby corrected as shown below:

Col. 1, line 48, "horespower" should be corrected to read -- horsepower --;

line 51, a comma should be inserted after "numbers".

Col. 3, line 26, "4" should be corrected to read -- 14 --;

line 41, "redjects" should be corrected to read -- rejects --;

Col. 4, line 34, "condit" should be corrected to read -- -- conduit --.

Col. 5, line 23, "not" should be corrected to read -- note --.

Col. 6, line 19, -- will -- should be inserted following "14";

line 59, "the" should be corrected to read -- The --;

line 60, -- a -- should be inserted following "in".

Col. 7, line 19, "as" should be corrected to read -- are --;

line 39, "concuit" should be corrected to read -- conduit --.

Col. 8, line 12, -- to -- should be inserted following "therefrom".

UNITED STATES PATENT AND TRADEMARK OFFICE

CERTIFICATE OF CORRECTION

PATENT NO. : 4,019,980

DATED : April 26, 1977

INVENTOR(S) : James P. Beery

It is certified that error appears in the above-identified patent and that said Letters Patent are hereby corrected as shown below:

Col. 9, line 6 (Claim 12, line 6), "pattern" should be corrected to read -- patterns --;

line 26 (Claim 15, line 3), -- a -- should be inserted following "stantially".

Col. 10, line 4, (Claim 18, line 1), "a" should be corrected to read -- A --;

line 14, (Claim 19, line 6), "conduits" should be corrected to read -- conduit --.

Signed and Sealed this

Twenty-eighth Day of June 1977

[SEAL]

*Attest:*

RUTH C. MASON
*Attesting Officer*

C. MARSHALL DANN
*Commissioner of Patents and Trademarks*